US008555686B2

(12) United States Patent
Meekma et al.

(10) Patent No.: US 8,555,686 B2
(45) Date of Patent: Oct. 15, 2013

(54) MECHANICAL PUSHBUTTON LOCKING ARRANGEMENTS

(75) Inventors: Glenn P. Meekma, Menomonee Falls, WI (US); Jerry Smith, Littleton, CO (US)

(73) Assignee: Master Lock Company LLC, Oak Creek, WI (US)

( * ) Notice: Subject to any disclaimer, the term of this patent is extended or adjusted under 35 U.S.C. 154(b) by 325 days.

(21) Appl. No.: 12/961,935

(22) Filed: Dec. 7, 2010

(65) Prior Publication Data

US 2011/0132049 A1 Jun. 9, 2011

Related U.S. Application Data

(60) Provisional application No. 61/267,276, filed on Dec. 7, 2009, provisional application No. 61/324,434, filed on Apr. 15, 2010.

(51) Int. Cl.

| | |
|---|---|
| ***E05B 15/00*** | (2006.01) |
| ***E05B 37/00*** | (2006.01) |
| *E05B 37/08* | (2006.01) |
| *E05B 65/00* | (2006.01) |

(52) U.S. Cl.

CPC ..... *E05B 37/00* (2013.01); *E05B 37/08* (2013.01); *E05B 65/0075* (2013.01)

USPC ..... 70/320; 70/315; 70/309; 70/301; 70/298; 70/330; 70/288; 70/306

(58) Field of Classification Search

USPC ..... 70/213–214, 220, 287–290, 297–299, 70/312–313, 323–324, 315, 309, 301, 296, 70/320, 306, 330, 337

See application file for complete search history.

(56) References Cited

U.S. PATENT DOCUMENTS

| | | | |
|---|---|---|---|
| 656,157 | A | 8/1900 | Alm |
| 1,085,894 | A | 2/1914 | Eagle |

(Continued)

FOREIGN PATENT DOCUMENTS

| | | |
|---|---|---|
| GB | 1497979 | 1/1978 |

OTHER PUBLICATIONS

International Search Report and Written Opinion from International Application No. PCT/US2010/049615, date of mailing Nov. 4, 2010.

(Continued)

*Primary Examiner* — Christopher Boswell
*Assistant Examiner* — David R Hare
(74) *Attorney, Agent, or Firm* — Calfee, Halter & Griswold LLP

(57) ABSTRACT

A lock includes a housing, a keypad disposed on the housing, and a latch assembled with the housing. The keypad includes a plurality of button assemblies, each including an axially depressible button member including a camming surface, a lock wheel having a plurality of camming teeth, and a latch releasing feature secured to the lock wheel for rotation therewith. Pressing the button member causes the camming surface to engage one of the plurality of calming teeth, thereby incrementally rotating the lock wheel between a plurality of rotational positions. When the button members of a predetermined one or more of the plurality of button assemblies are depressed a predetermined number of times, the latch releasing features of each of the plurality of button assemblies align with a plurality of blocking features of the latch to permit lateral sliding movement of the latch from a locked condition to an unlocked condition.

22 Claims, 15 Drawing Sheets

(56) References Cited

U.S. PATENT DOCUMENTS

| | | | | | |
|---|---|---|---|---|---|
| 1,092,733 | A | | 4/1914 | McCarthy | |
| 1,185,468 | A | | 5/1916 | Borg | |
| 1,276,633 | A | | 8/1918 | Forbes | |
| 1,423,691 | A | | 7/1922 | Sokolov | |
| 1,480,760 | A | | 1/1924 | Hill | |
| 1,899,996 | A | | 3/1933 | Sullivan | |
| 1,910,125 | A | | 5/1933 | Root | |
| 2,029,080 | A | | 1/1936 | Mills | |
| 2,109,264 | A | | 2/1938 | Elbaum | |
| 2,165,067 | A | | 7/1939 | Pfendner | |
| 2,529,119 | A | | 11/1950 | Wallach et al. | |
| 2,536,429 | A | | 1/1951 | Dury | |
| 2,628,490 | A | | 2/1953 | Klein | |
| 2,640,346 | A | | 6/1953 | Giffin | |
| 2,665,577 | A | | 1/1954 | Sanowskis | |
| 2,706,393 | A | | 4/1955 | Jamieson et al. | |
| 2,785,564 | A | | 3/1957 | Rossi | |
| 3,009,346 | A | | 11/1961 | Check | |
| 3,040,556 | A | | 6/1962 | Rosenhagen | |
| 3,099,150 | A | | 7/1963 | Check | |
| 3,115,028 | A | | 12/1963 | Windle | |
| 3,115,765 | A | | 12/1963 | Fengler | |
| 3,187,528 | A | | 6/1965 | Check | |
| 3,357,216 | A | | 12/1967 | Cook | |
| 3,379,040 | A | | 4/1968 | Shimono | |
| 3,412,587 | A | | 11/1968 | Sanowskis | |
| 3,462,981 | A | | 8/1969 | Leblanc | |
| 3,667,261 | A | | 6/1972 | McGourty | |
| 3,910,078 | A | * | 10/1975 | Schulz | 70/30 |
| 3,937,046 | A | | 2/1976 | Wang | |
| 3,952,562 | A | * | 4/1976 | Snow | 70/476 |
| 4,014,194 | A | | 3/1977 | Hartman | |
| 4,027,508 | A | | 6/1977 | McGourty | |
| 4,070,881 | A | | 1/1978 | Shimono | |
| 4,133,074 | A | | 1/1979 | Schack | |
| 4,196,603 | A | | 4/1980 | Malacheski et al. | |
| 4,350,031 | A | | 9/1982 | Shimono | |
| 4,354,365 | A | * | 10/1982 | Mayer et al. | 70/30 |
| 4,602,491 | A | * | 7/1986 | Mauer | 73/312 |
| 4,627,250 | A | * | 12/1986 | Kim | 70/214 |
| 4,671,084 | A | | 6/1987 | Lin | |
| 4,748,833 | A | | 6/1988 | Nagasawa | |
| 4,766,746 | A | | 8/1988 | Henderson | |
| 4,794,768 | A | | 1/1989 | Moser et al. | |
| 4,799,371 | A | | 1/1989 | Duncan | |
| 4,851,652 | A | | 7/1989 | Imran | |
| 4,866,958 | A | | 9/1989 | Bretl et al. | |
| 4,936,894 | A | | 6/1990 | Larson et al. | |
| 4,952,228 | A | | 8/1990 | Taylor et al. | |
| 4,959,978 | A | | 10/1990 | Cappell | |
| 5,040,652 | A | | 8/1991 | Fish et al. | |
| 5,058,404 | A | | 10/1991 | Fish et al. | |
| 5,335,521 | A | * | 8/1994 | Brooks | 70/298 |
| 5,720,193 | A | | 2/1998 | Dick | |
| 5,768,921 | A | | 6/1998 | Hill | |
| D411,949 | S | | 7/1999 | Hill | |
| 5,924,313 | A | * | 7/1999 | Kuo | 70/26 |
| 6,000,254 | A | | 12/1999 | Raybary | |
| 6,026,665 | A | | 2/2000 | Raybary | |
| 6,145,355 | A | | 11/2000 | Burleigh et al. | |
| 6,272,889 | B1 | | 8/2001 | Burleigh et al. | |
| 6,298,698 | B1 | | 10/2001 | Nakajima et al. | |
| 6,334,346 | B1 | * | 1/2002 | Wang | 70/214 |
| 6,484,545 | B1 | | 11/2002 | Peter et al. | |
| 6,487,803 | B1 | | 12/2002 | Yu | |
| 6,550,296 | B2 | * | 4/2003 | Segawa | 70/208 |
| 6,564,598 | B2 | * | 5/2003 | Segawa | 70/208 |
| 6,575,004 | B2 | | 6/2003 | Berton et al. | |
| 6,755,059 | B1 | | 6/2004 | Nall | |
| 6,874,339 | B2 | | 4/2005 | Segawa | |
| 7,043,948 | B1 | | 5/2006 | Wang | |
| 7,100,402 | B2 | | 9/2006 | Holmgren | |
| 7,316,139 | B2 | | 1/2008 | Nakazima et al. | |
| 7,318,331 | B2 | * | 1/2008 | Miao | 70/214 |
| 2003/0126896 | A1 | | 7/2003 | Mori | |
| 2003/0179075 | A1 | | 9/2003 | Greenman | |
| 2004/0226325 | A1 | | 11/2004 | Ling | |
| 2004/0261477 | A1 | * | 12/2004 | Wang | 70/214 |
| 2005/0210937 | A1 | | 9/2005 | Okuda | |
| 2006/0213237 | A1 | | 9/2006 | Yang | |
| 2007/0144226 | A1 | | 6/2007 | Miao | |
| 2008/0115546 | A1 | | 5/2008 | Hu | |
| 2009/0013737 | A1 | * | 1/2009 | Talpe | 70/285 |
| 2009/0095036 | A1 | | 4/2009 | Ng et al. | |

OTHER PUBLICATIONS

International Search Report and Written Opinion from International Application No. PCT/US2010/059217, date of mailing Feb. 8, 2011.

* cited by examiner

MECHANICAL PUSHBUTTON LOCKING ARRANGEMENTS

CROSS-REFERENCE TO RELATED APPLICATION

This application claims the benefit of U.S. Provisional Patent application Ser. No. 61/267,276, entitled MECHANICAL PUSHBUTTON LOCKING ARRANGEMENTS and filed Dec. 7, 2009, and U.S. Provisional Patent Application Ser. No. 61/324,434, entitled MECHANICAL PUSHBUTTON LOCKING ARRANGEMENTS and filed Apr. 15, 2010, the entire disclosures of both of which are incorporated herein by reference.

BACKGROUND

Lockable enclosures are used in many indoor and outdoor environments to restrict access to various items by providing the enclosure with a lockable door, lid, drawer, or other such barrier. The bather can include a locking mechanism, such as, for example, a combination lock, padlock, set of pushbuttons, or key operated latch, to limit access to the contents of the enclosure to one or more authorized users. Some applications may require secure storage of one or more smaller items, such as keys, credit cards, or documents, for which restricted access by a limited number of authorized individuals is desirable. One example of such an enclosure is a key safe, which is affixed to an entry door (e.g., shackled around the doorknob) of a building for secure retention of an authorized key for the entry door. The key safe may employ, for example, a pushbutton or combination dial locking mechanism, such that authorized users informed of the unlocking combination may open the key safe to access the door key for entry into the building.

Mechanical pushbutton combination locks have been provided, for example, to allow for a pushbutton locking arrangement without requiring an electrical power source to maintain accessibility to the locking mechanism (i.e., without risk associated with power outages or battery depletion). Conventional mechanical pushbutton combination locks employ a series of buttons each operable between two different states or conditions—a depressed or selected condition and a non-pressed or unselected condition. When the correct buttons (and only the correct buttons) have been depressed, a lock member associated with the locking arrangement becomes movable from the locked condition to the unlocked condition. When at least one of the incorrect buttons has been depressed or when at least one of the correct buttons has not been depressed, the lock member remains blocked from movement to the unlocked condition. In this type of arrangement, the number of potential combination codes is limited by the fact that the combination codes are not sequence-dependent, and that each button has only two states—a selected condition and a non-selected condition.

SUMMARY

The present application describes mechanical locking arrangements that are operable by pushbutton entry of a combination code using a set of pushbuttons or a keypad. According to one aspect of the present application, a locking arrangement may be configured to utilize authorized combination codes requiring multiple pressings of one or more buttons, thereby increasing the number of possible combination codes for increased security.

Accordingly, in an exemplary embodiment of the present application, a lock includes a housing, a keypad disposed on the housing, and a latch assembled with the housing. The keypad includes a plurality of button assemblies, each including an axially depressible button member including a camming surface, a lock wheel having a plurality of camming teeth, and a latch releasing feature secured to the lock wheel for rotation therewith. Pressing the button member causes the camming surface to engage one of the plurality of camming teeth, thereby incrementally rotating the lock wheel between a plurality of rotational positions. When the button members of a predetermined one or more of the plurality of button assemblies are depressed a predetermined number of times, the latch releasing features of each of the plurality of button assemblies align with a plurality of blocking features of the latch to permit lateral sliding movement of the latch from a locked condition to an unlocked condition.

BRIEF DESCRIPTION OF THE DRAWINGS

Further features and advantages of the invention will become apparent from the following detailed description made with reference to the accompanying drawings, wherein.

DETAILED DESCRIPTION OF THE INVENTION

Figure 1:
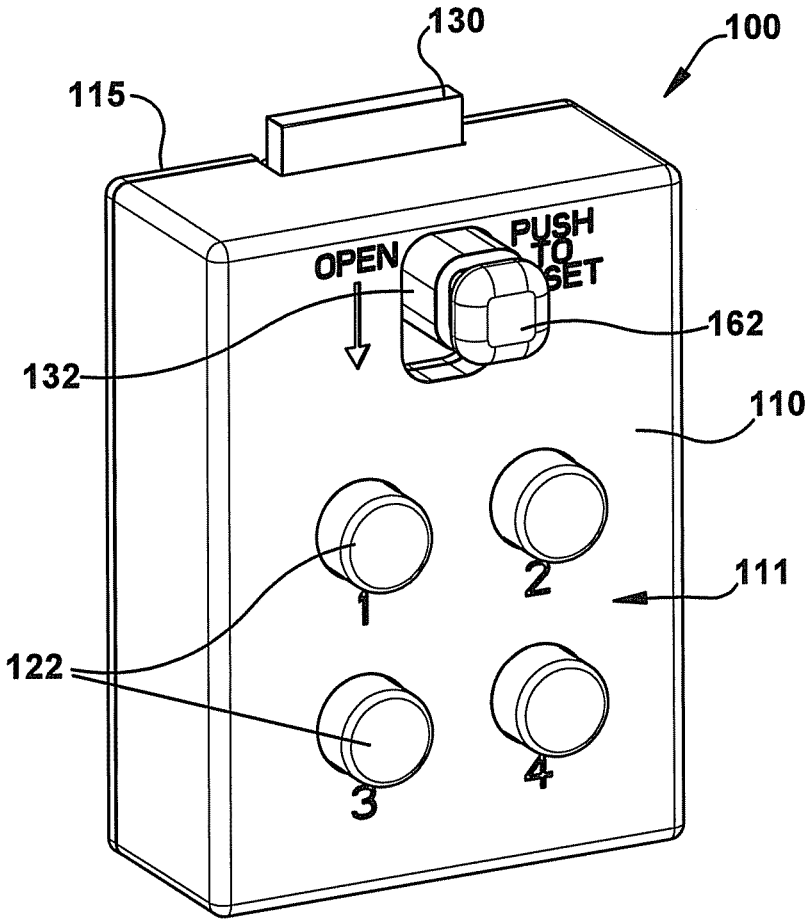
FIG. 1 is a front perspective view of s mechanical pushbutton locking arrangement.
Figure 2:
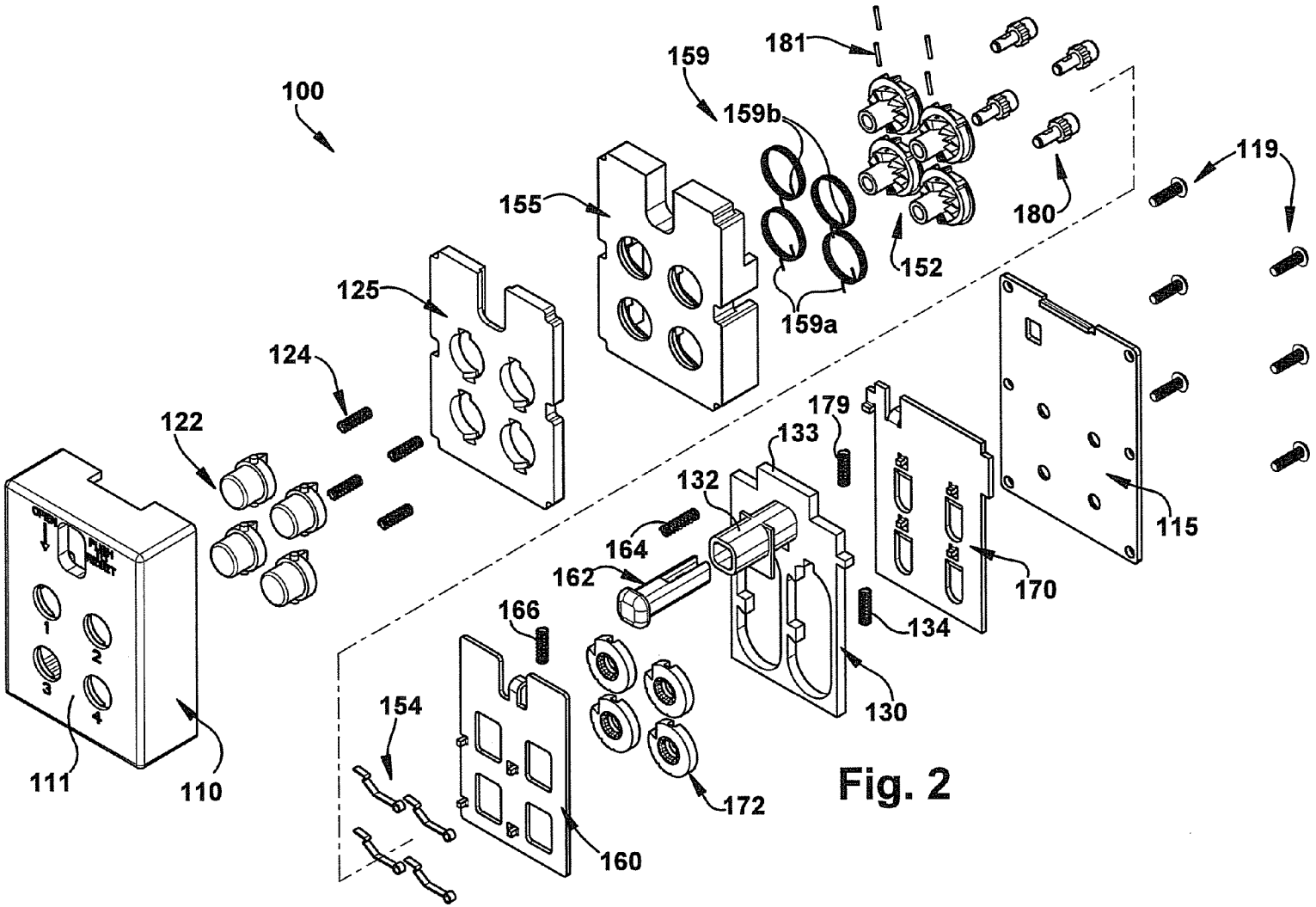
FIG. 2 is an exploded perspective view of the locking arrangement of FIG. 1.

This Detailed Description of the Invention merely describes embodiments of the invention and is not intended to limit the scope of the claims in any way. Indeed, the invention as claimed is broader than and unlimited by the preferred embodiments, and the terms used in the claims have their full ordinary meaning.

Also, while the exemplary embodiments described in the specification and illustrated in the drawings relate to a mechanical pushbutton safe or lock box sized to store smaller items, such as door keys, it should be understood that many of the inventive features described herein may be applied to other sizes and types of lockable enclosures, including, for example, larger safes and cash boxes, and to other locking arrangements, including, for example, door locks and padlocks.

The present application contemplates a mechanical pushbutton locking arrangement in which a locking member is changed from a locked or inoperable condition to an unlocked or operable condition by pressing one or more of a plurality of buttons disposed on a keypad of the locking arrangement, in accordance with an authorized combination code. According to one feature described in the present application, a locking arrangement may be adapted to allow for an authorized combination code that requires at least one of the one or more buttons to be depressed multiple times during entry of the combination code. While any number of multiple pressings or selections of a button may be permitted, in one embodiment, each button may be depressed up to four times. As a result, an exemplary locking arrangement having a keypad with ten buttons, with each button being operable to one of five different conditions (non-pressed and depressed one, two, three, or four times), would allow for $5^{10}$ or 9,765,625 different combination codes. By comparison, a ten button keypad locking arrangement with buttons operable between two conditions (depressed and non-pressed) would allow for $2^{10}$ or 1,024 different combination codes. Further, allowing for multiple pressings of one or more of the buttons would enable a user to set the authorized combination code to correspond to a number having significance to the user (for example, a date, address or phone number) or an easy-to-remember word to facilitate memorization of the combination code.

According to another aspect of the present application, each of a plurality of buttons may be configured to incrementally rotate a corresponding lock wheel each time the button is depressed. In such an embodiment, when a notch (or other unlocking feature) associated with each lock wheel is rotated into alignment with a corresponding tab (or other unlocking feature) associated with a latch mechanism, the latch mechanism is slideable from a securing position to a releasing position.

According to still another aspect of the present application, the positions of incrementally rotatable lock wheels associated with buttons of a pushbutton locking arrangement may be reset to their non-pressed orientations, for example, to clear a combination entry if an incorrect button has been inadvertently depressed or a button has been inadvertently depressed too many times. In one such embodiment, the lock wheels may each be rotationally biased to their non-pressed orientation (e.g., by corresponding torsion springs). When a lock wheel ratcheting mechanism is disengaged from each of the lock wheels (e.g., by user manipulation of a reset lever or button), the lock wheels rotate back to their non-pressed orientations.

According to yet another aspect of the present application, the unlocking orientations of incrementally rotatable lock wheels associated with buttons of a pushbutton locking arrangement may be selected or changed by a user, for example, to provide for an authorized combination code that is more easily memorized by the user. In one such embodiment, combination selection members including latch-engaging unlocking features (e.g., notches) may be rotationally fixed and disengaged from the corresponding lock wheels (e.g., by user manipulation of a code change lever or button) when each of the lock wheels has been rotated to the unlocking orientation. Upon disengagement of the combination selection members from the lock wheels, the lock wheels may be rotated to new unlocking orientations (e.g., by pressing the corresponding buttons) before re-engaging the combination selection members with the lock wheels.

FIGS. 1-19B illustrate various views of an exemplary pushbutton locking arrangement 100 including inventive features of the present application. As shown in FIG. 1, the locking arrangement 100 includes a housing member 110 defining a keypad portion 111 on which a plurality of buttons members 122 is disposed. In the illustrated example, the housing is configured to function as a door to a key safe or other small safe enclosure, for example, by hingedly securing or otherwise attaching the door housing 110 to a safe enclosure (as shown, for example, in the embodiment of FIGS. 20 and 21). A latch member 133 extends from a slot in the housing 110 and is securable in a locked condition when the authorized combination code has not been entered. Upon entry of the authorized combination code (i.e., by pressing the button member(s) 122 corresponding to the combination code), the latch member 133 becomes movable from a securing or locked position to a releasing or unlocked position, for example, by user manipulation of a latch release button 132 associated with the latch member 133. While the illustrated arrangement is configured to be provided as a lockable door to a key safe or other small locking enclosure, a similar locking arrangement may be provided for an entry door, gate, padlock or other lockable structure. Also, while the illustrated embodiment includes four button members 122 labeled (by markings on the housing proximate the buttons) 1 through 4, it is to be understood that any number of buttons may be used, and that any one or more types of labeling or designations may be used to identify the buttons, including, for example, numbers, letters, colors, and images.

Many different configurations may be utilized to rotate locking wheels associated with the buttons of a mechanical pushbutton locking arrangement. In one embodiment, each button may include a lock wheel engaging camming surface that engages one of a plurality of camming teeth on the corresponding lock wheel to incrementally rotate the lock wheel when the corresponding button is depressed. The lock wheels may be provided with a number of camming teeth corresponding to the number of times that the corresponding button may be depressed during entry of a combination code.

Figure 4:
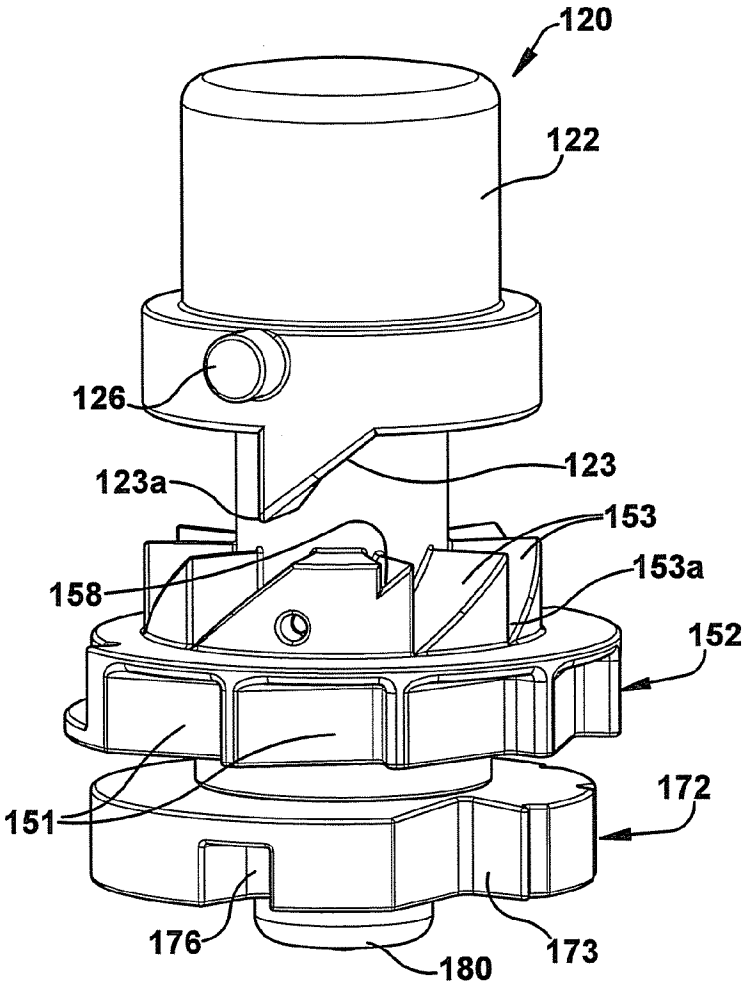
FIG. 4 is another perspective view of the pushbutton assembly of FIG. 3, shown without the leaf spring and torsion spring.
Figure 3:
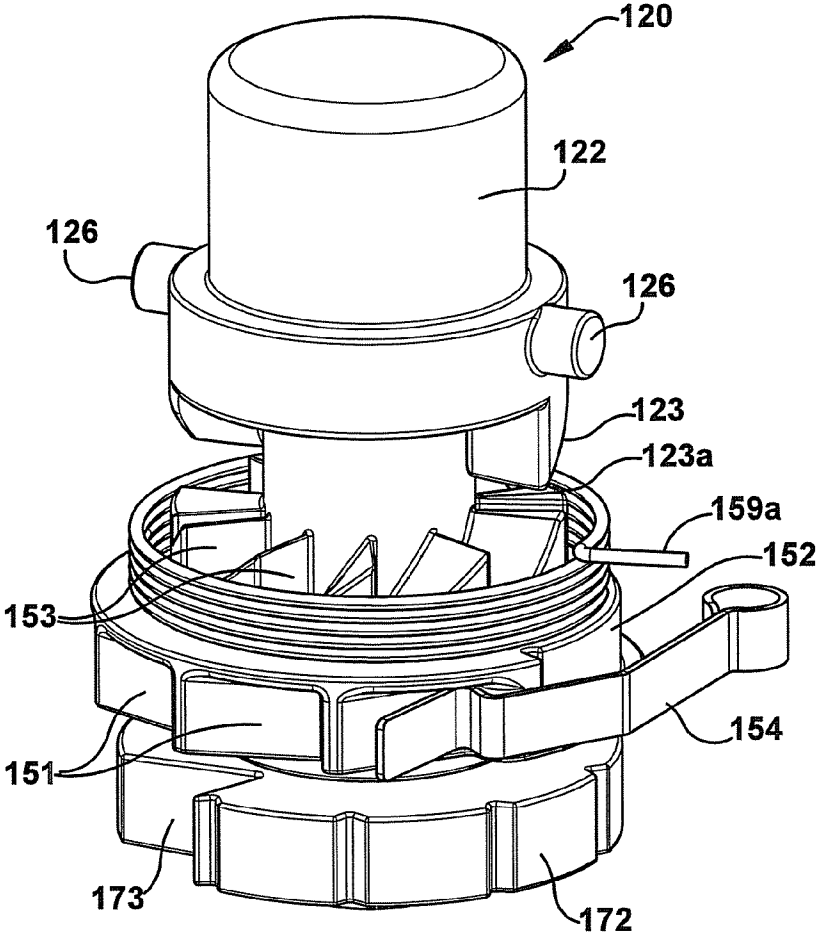
FIG. 3 is a perspective view of a pushbutton assembly of the locking arrangement of FIG. 1.
Figure 6:
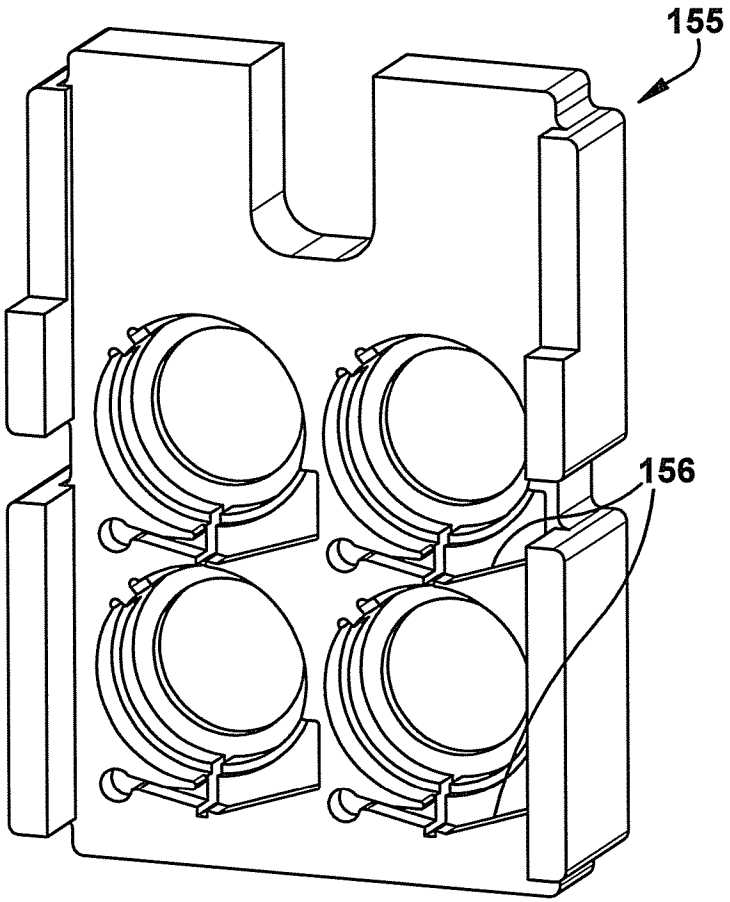
FIG. 6 is a perspective view of the lock wheel guide block of the locking arrangement of FIG. 1.
Figure 5:
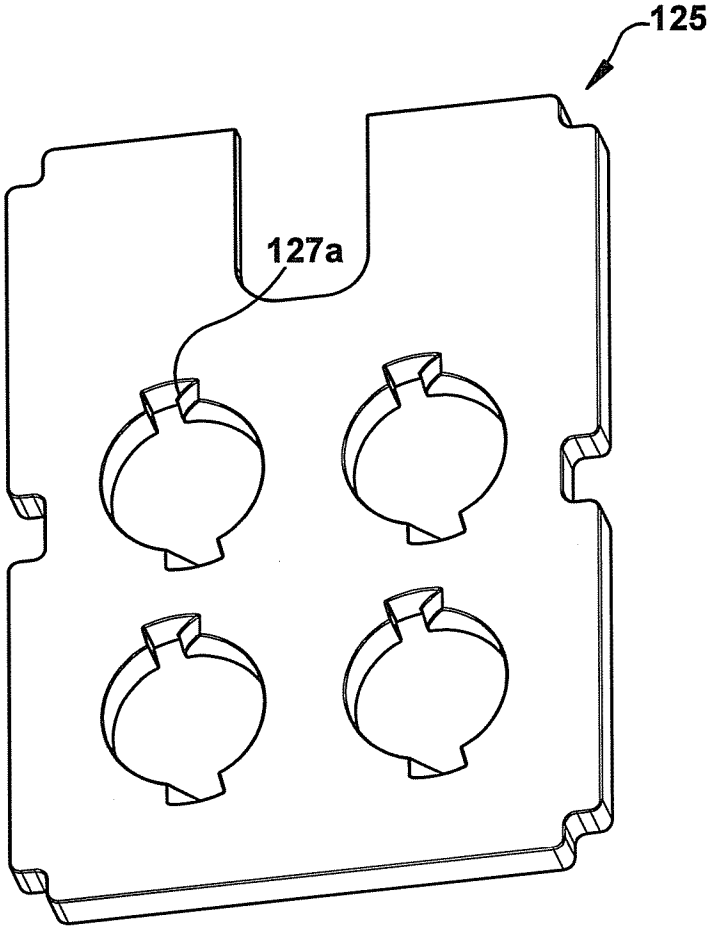
FIG. 5 is a perspective view of the button guide plate of the locking arrangement of FIG. 1.
Figure 7:
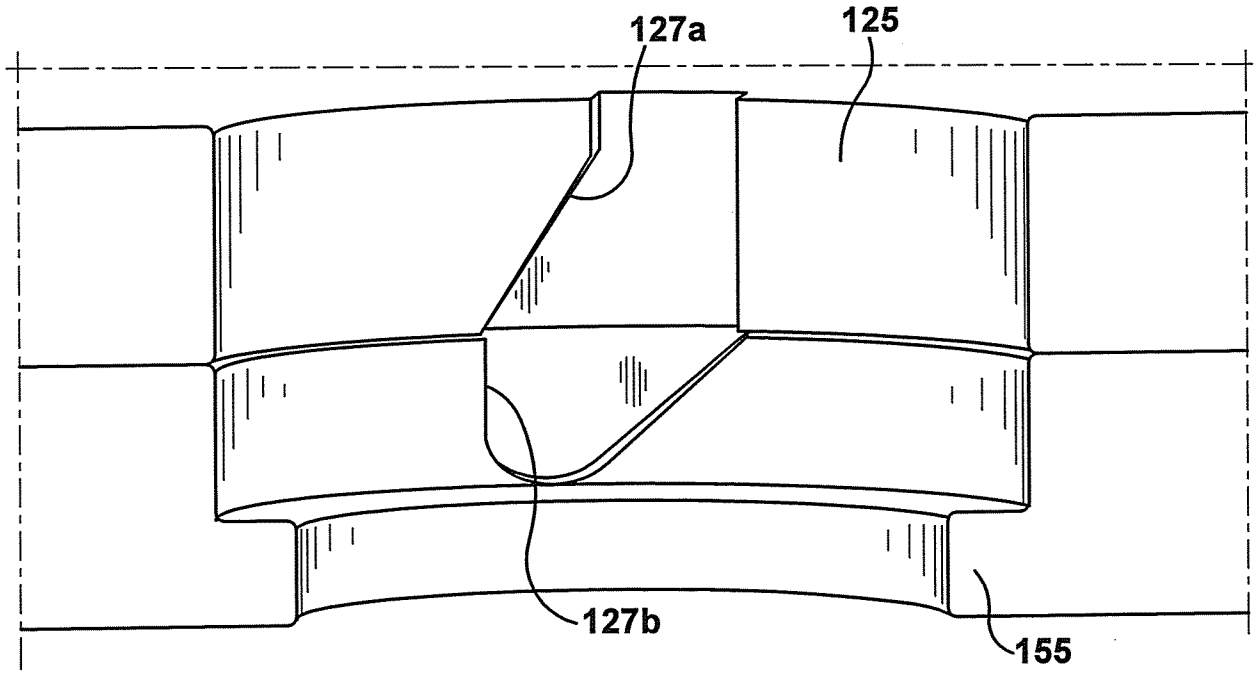
FIG. 7 is a partial cross-sectional view of the button guide plate and housing member of the locking arrangement of FIG. 1.
Figure 9:
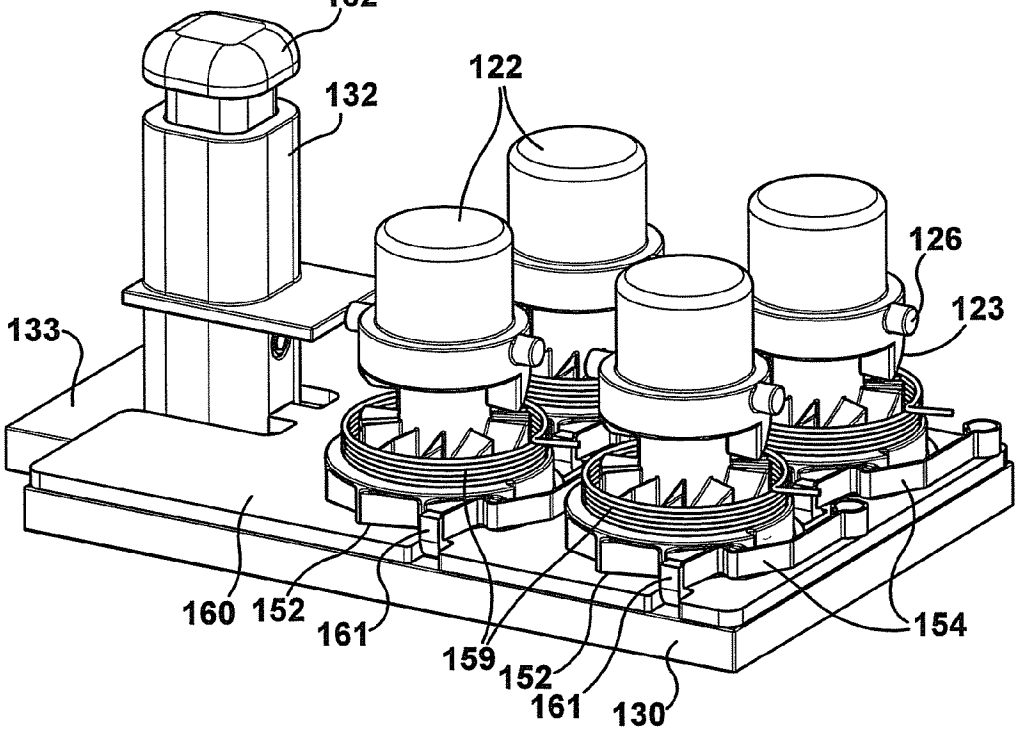
FIG. 9 is a perspective view of the latch plate, reset plate, and pushbutton subassemblies of the locking arrangement of FIG. 1.
Figure 8:
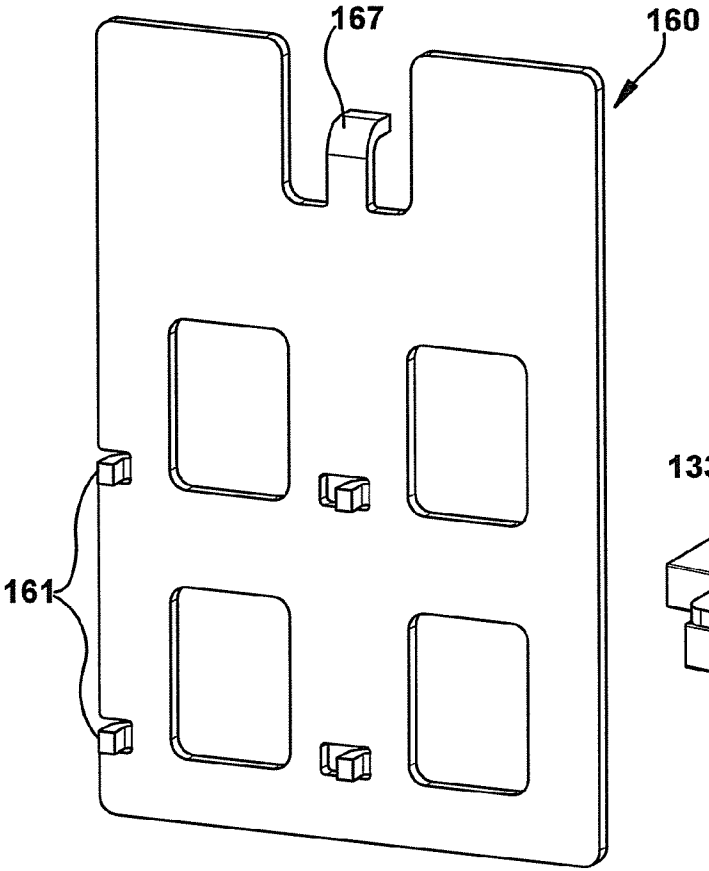
FIG. 8 is a perspective view of the reset plate of the locking arrangement of FIG. 1.
Figure 10B:
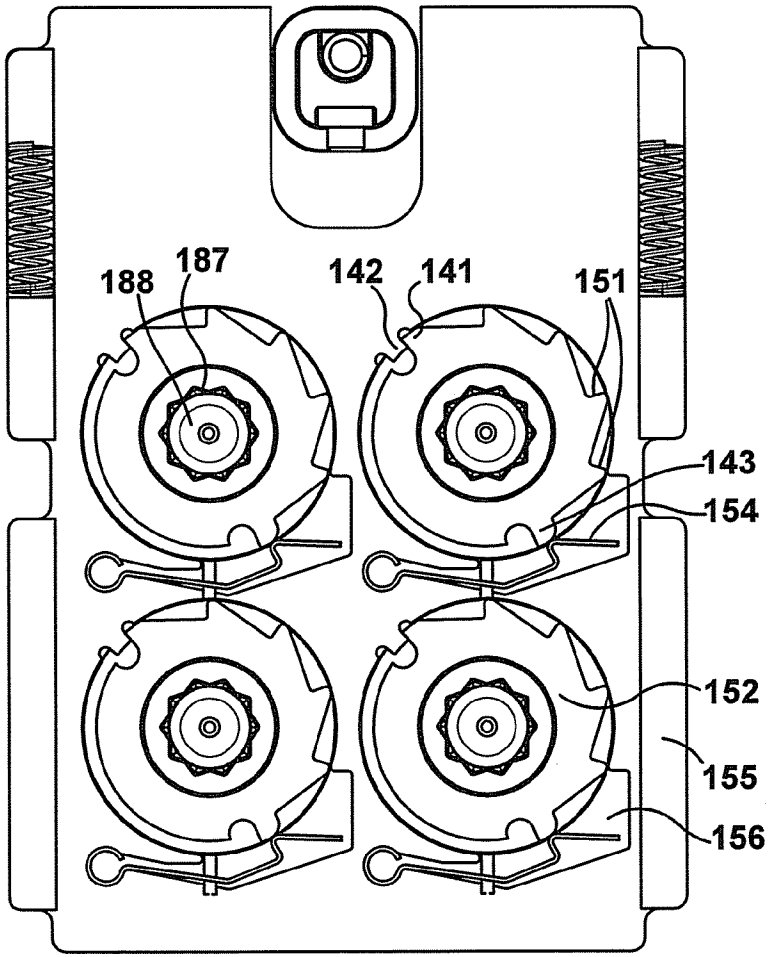
FIG. 10B is a partial rear perspective view of the button guide plate, lock wheel guide block, and pushbutton subassemblies of the locking arrangement of FIG. 1, showing the lock wheels in a zero or reset position.
Figure 10A:
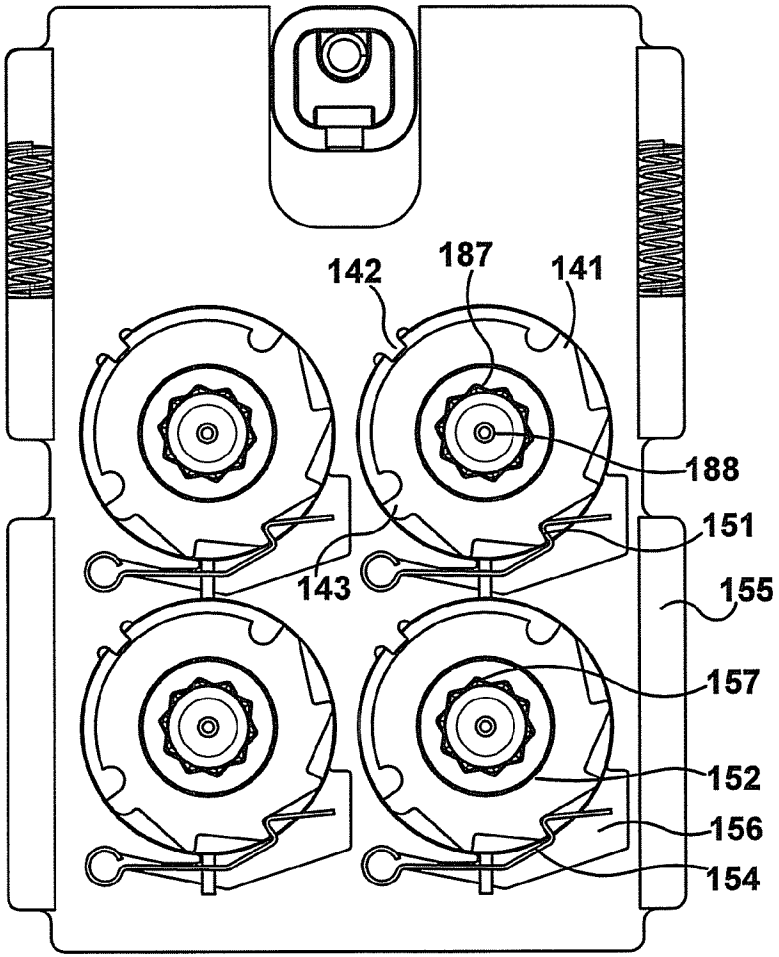
FIG. 10A is a partial rear perspective view of the button guide plate, lock wheel guide block, and pushbutton subassemblies of the locking arrangement of FIG. 1, showing the lock wheels in a rotated position.
Figure 12:
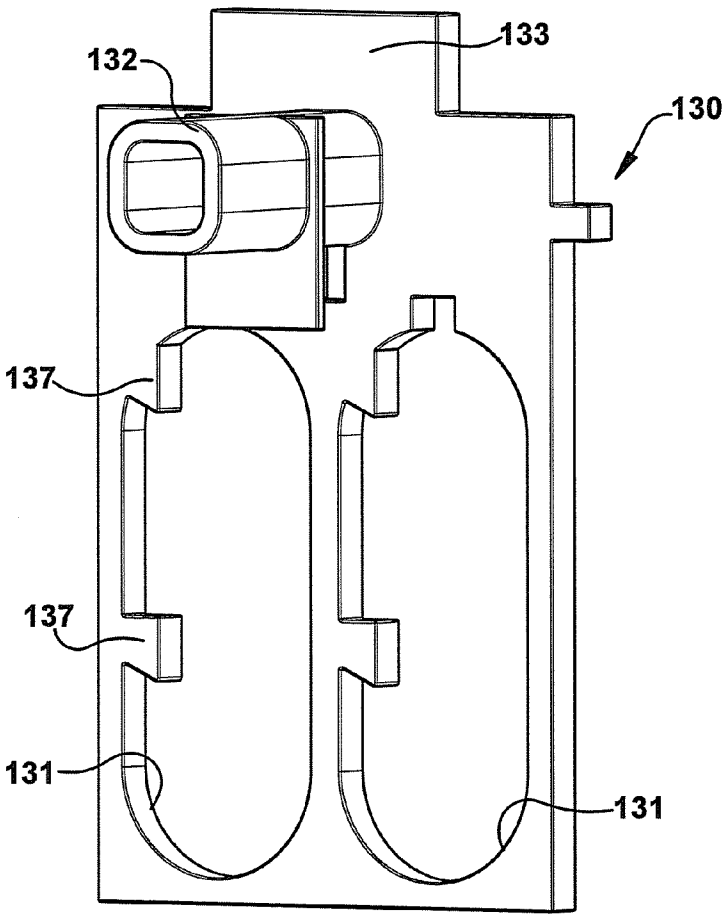
FIG. 12 is a perspective view of the latch plate of the locking arrangement of FIG. 1.

In the illustrated embodiment, as shown in FIGS. 3 and 4, each button member 122 is provided in a pushbutton or button assembly 120, in which the button member 122 assembled with a corresponding lock wheel 152 axially aligned with the button member 122. As shown in the exploded view of FIG. 2, the buttons 122 are seated in a button guide plate 125 (see also FIG. 5) assembled with the housing member 110 as part of the housing, and the lock wheels 152 are retained in a lock wheel guide block 155 (see also FIG. 6) adjacent to the button guide plate 125. When the button member 122 is depressed, camming surfaces 123 on the button member 122 are axially driven against rotationally aligned teeth 153 on the lock wheel 152. The axial force of the camming surface 123 against the corresponding teeth 153 rotates the lock wheel 152 until the leading edge 123*a* of the camming surface 123 is seated in the root 153*a* (FIG. 4) between adjacent camming teeth 153 of the lock wheel 152. When the depressed button member 122 is release by the user, a spring 124 (FIGS. 2 and 19A) disposed between the button member 122 and the lock wheel 152 axially biases the button member 122 outward and out of camming engagement with the lock wheel 152. A leaf spring 154 (FIG. 3) or other such ratcheting member engages a peripheral gear tooth 151 of the lock wheel 152 to rotationally fix the lock wheel 152. Each leaf spring 154 is disposed in a corresponding cavity 156 in the lock wheel guide block 155 (FIGS. 6, 10A, and 10B). The leaf spring 154 permits forward (clockwise in the view of FIGS. 10A and 10B) incremental rotation of the lock wheel 152 in response to pressing the corresponding button member 122, while blocking backward (counterclockwise in the view of FIGS. 10A and 10B) rotation of the lock wheel 152.

To facilitate a subsequent incremental rotation of the lock wheel 152 by an additional pressing of the button member 122, the locking mechanism may be configured to align the camming surface 123 of the released button member 122 with the next camming tooth 153. While many different configurations may be utilized to reorient the camming surface 123 with respect to the camming teeth 153, in one embodiment, the button member 122 is configure to rotate upon release for alignment with the next camming tooth 153. In the illustrated embodiment, axial movement of the buttons 122 is guided by the button guide plate 125 and the housing member 110. Each button member 122 includes a peripheral projection or post 126 that rides in a ramped slot 127*a*, 127*b* (see FIG. 7) defined by the button guide plate 125 and housing member 110. The ramped slot 127*a*, 127*b* is angled to rotate the camming surface 123 of the button member 122 into alignment with the next camming tooth 153 of the lock wheel 152, such that a subsequent pressing of the button member 122 will rotate the lock wheel 152 an additional increment.

The pushbutton assembly 120 may further be configured to limit the number of times a button member 122 may be depressed when entering a combination code. In the illustrated example, each button member 122 may be depressed up to four times to incrementally rotate the corresponding lock wheel 152. To prevent further incremental rotation of lock wheel from additional pressings of the button member 122, a notch 158 (FIG. 4) may be positioned adjacent to the fourth camming tooth 153, in a location substantially rotationally aligned with the leading edge 123*a* of the button camming surface 123 after the button member 122 has been released from its fourth pressing (after rotation of the button member 122 within the ramped slot 127*a*, 127*b*). The notch 158 may be shaped to receive the leading edge 123*a* of the camming surface 123 without further rotating the lock wheel 152, thereby providing the user with a "positive stop" indication that the button member 122 has reached its maximum number of pressings.

Figure 11:
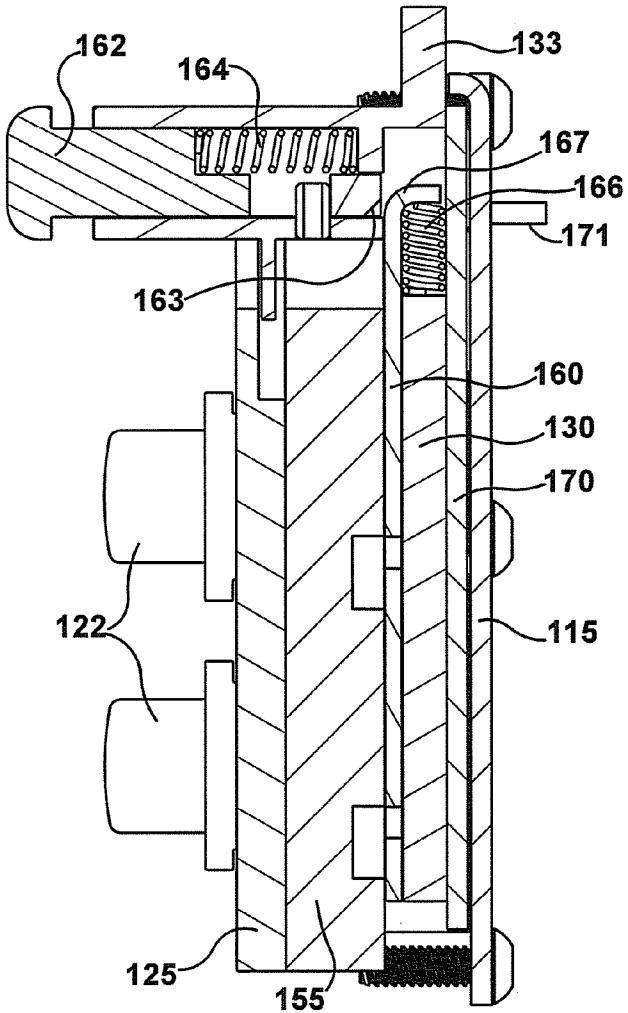
FIG. 11 is a side cross-sectional view of the locking arrangement of FIG. 1, shown with the housing removed.
Figure 13:
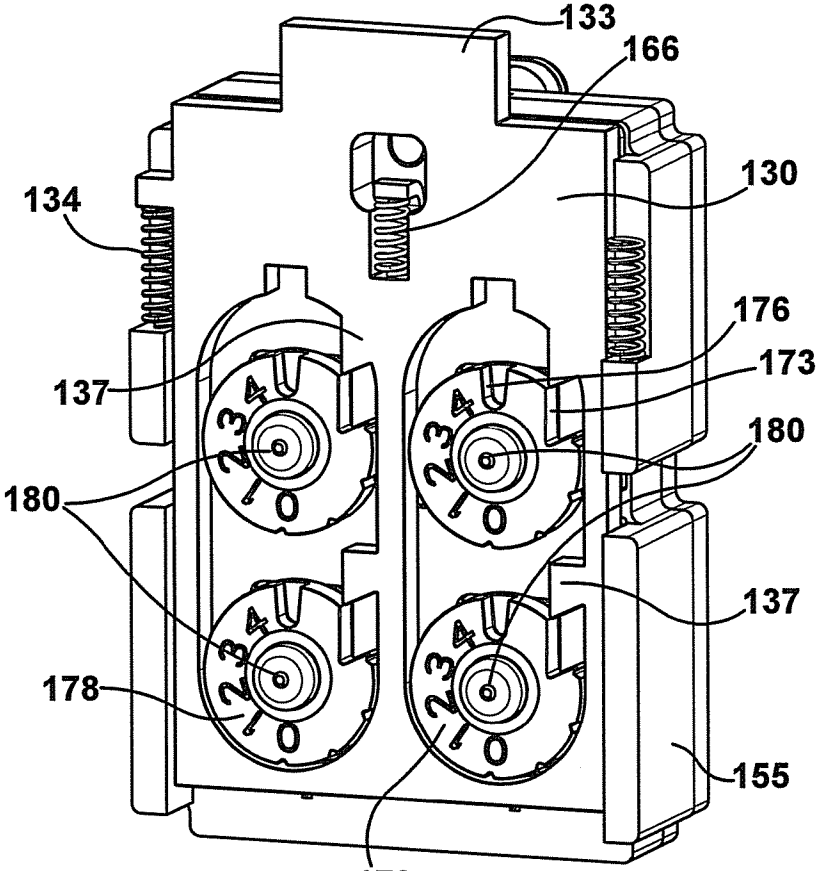
FIG. 13 is a rear perspective view of the locking arrangement of FIG. 1, with the housing, rear wall, and combination change plate removed.

If an incorrect button member 122 is inadvertently depressed, or if a button is depressed too many times, the lock wheels 152 may be reset or returned to an initial or "zero" position for reentry of the combination code. While many different configurations may be utilized for resetting the buttons 122, in one embodiment, the lock wheels 152 may be rotationally biased toward the zero position, with a ratcheting mechanism (e.g., the leaf spring 154) securing the incrementally rotated lock wheels against spring biased movement toward the zero position. In such an embodiment, a reset mechanism may be configured to disengage the ratcheting mechanism from each of the locking wheels, thereby allowing the locking wheels to rotate back to the zero position. In the illustrated embodiment, a reset plate 160 (FIGS. 8 and 9) is disposed within the housing 110 adjacent the lock wheel guide block 155. When the reset plate 160 is laterally moved (perpendicular to the axial movement of the buttons 122) with respect to the lock wheel guide block 155, tabs 161 extending from the reset plate 160 force the leaf springs 154 out of engagement with the peripheral gear teeth 151 of the lock wheels 152, allowing the lock wheels 152 to be rotationally biased back to the zero positions by torsion springs 159. As shown in FIGS. 10A and 10B, each lock wheel 152 includes a radially outward extending protrusion 141 that abuts a corresponding tab 142 in the lock wheel guide block 155 upon rotation of the lock wheel 152 by the torsion spring 159, thereby establishing the zero position. A second protrusion 143 on the lock wheel 152 provides a surface for interlocking engagement with the leaf spring 159 when the reset plate is returned to the normal position. Each torsion spring 159 has a first end 159*a* secured to the lock wheel guide block 155 and a second end 159*b* (FIG. 2) secured to the lock wheel 152. While many different configurations may be utilized to slide the reset plate 160 from a normal condition to a reset condition, in the illustrated embodiment, as shown in FIGS. 1 and 11, a reset button 162 extending through the front of the housing 110 may be pressed to engage a camming end 163 of the reset button 162 with an upper edge 167 of the reset plate 160, thereby sliding the plate 160 such that the tabs 161 disengage the leaf springs 154 from the corresponding lock wheels 152. The reset button 162 is spring biased (by spring 164) to return the reset button 162 to the non-pressed condition, and the reset plate 160 is spring biased (by spring 166) to return the reset plate 160 to the normal position when the reset button 162 is released.

Figure 14B:
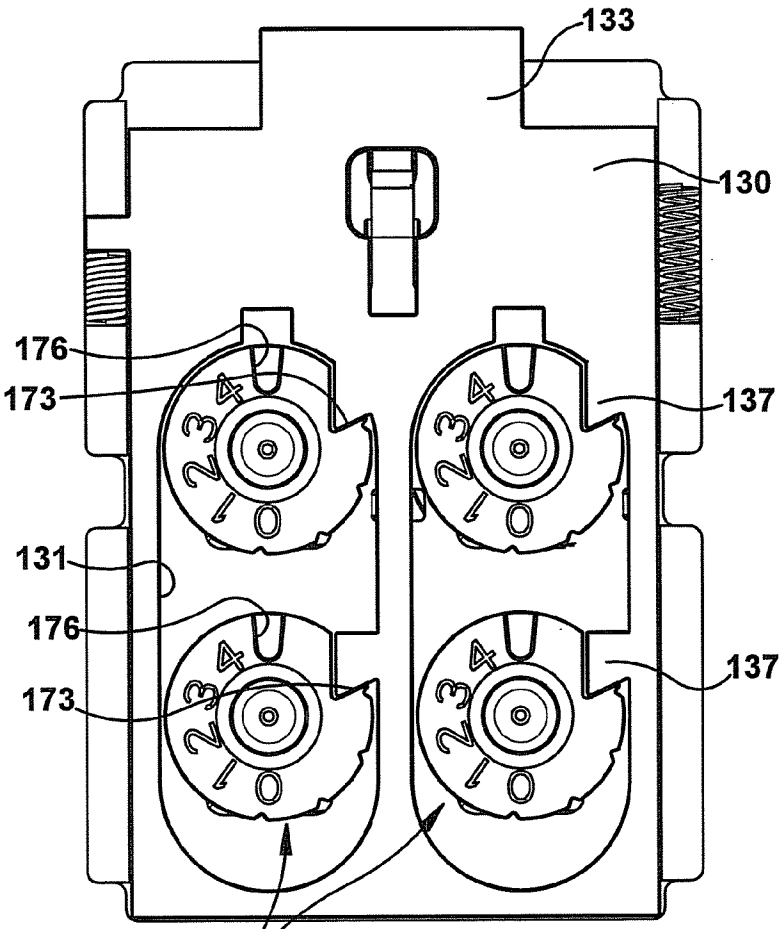
FIG. 14B is a rear view of the locking arrangement of FIG. 1, with the housing, rear wall, and combination change plate removed, shown in an unlocked condition.
Figure 14A:
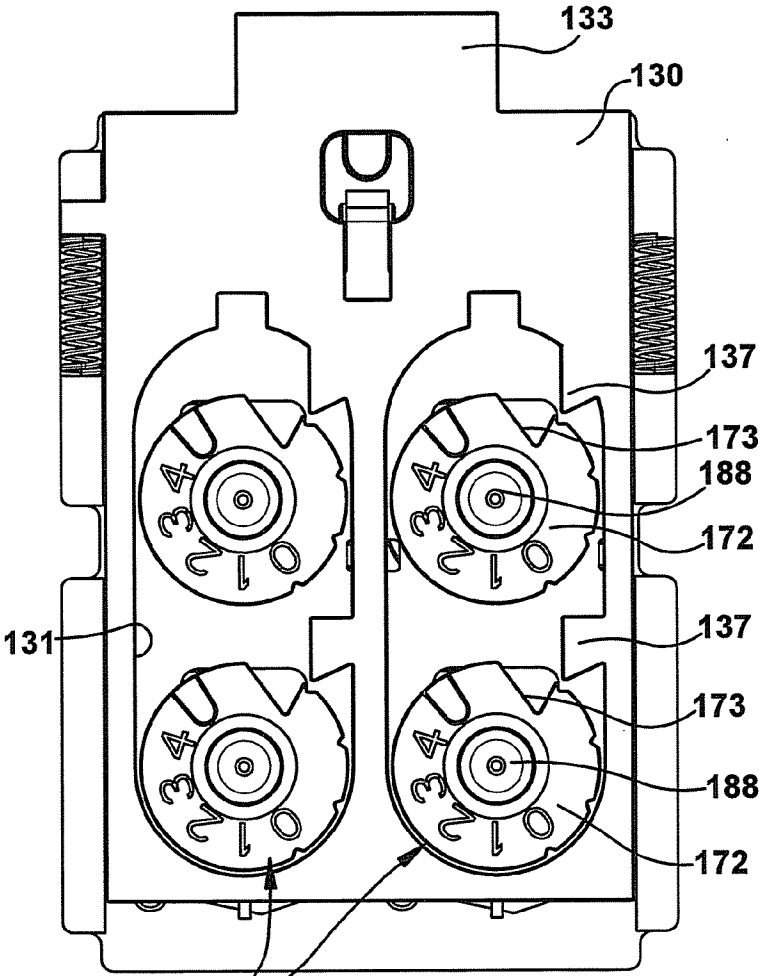
FIG. 14A is a rear view of the locking arrangement of FIG. 1, with the housing, rear wall, and combination change plate removed, shown in a locked condition.

While many different configurations may be provided for locking and unlocking the latch member 133, in one embodiment, the latch member 133 is associated with (e.g., integral with or affixed to) a latch plate 130 (see FIGS. 12 and 13) slideably disposed within the housing 110. The latch plate 130 may be blocked from sliding lateral movement when the authorized combination code has not been entered (FIG. 14A), and permitted to slide (i.e., for movement of the latch member) when the authorized combination code has been entered (FIG. 14B). In the illustrated embodiment, a latch plate 130 integral with the latch member 133 includes cutout portions 131 through which the pushbutton assemblies 120 extend. When the authorized combination code has been entered by pressing the corresponding buttons 122 a correct number of times (placing each lock wheel 152 in an unlocking rotational orientation), outer peripheral notches 173 (or any other suitable latch releasing features) associated with each of the lock wheels 152 align with corresponding tabs or protrusions 137 (or any other suitable blocking features) in the latch plate 130. This arrangement allows the latch plate 130 to laterally slide against a biasing spring 134 to a release position, by user manipulation of the attached latch release button 132, thereby withdrawing or retracting the latch member 133 to disengage the latch member from a lockable structure (e.g., a safe enclosure, not shown).

In one embodiment, the outer peripheral notch 173 (or other unlocking feature) may be disposed on a component that is separable from, and rotationally adjustable with respect to, the lock wheel 152, for adjustment of the rotational position of the notch 173 with respect to the camming teeth 153 of the lock wheel 152, to allow for an unlocking position that corresponds to a different number of pressings (including zero) of the corresponding button member 122. In one embodiment, a fastener connects each lock wheel to a corresponding combination selection member in a selected rotational orientation. A locking arrangement may be configured to require disassembly of the lock to adjust the orientation of the lock wheel with respect to the combination selection member. In other embodiments, a user operable mechanism (e.g., a lever or button) may be configured to rotationally fix the combination selection members and disengage them from the corresponding lock wheels, such that the lock wheels may be re-oriented with respect to the combination selection members (e.g., by one or more pressings of the corresponding buttons) to establish new unlocking orientations for the lock wheels. In one such embodiment, a slideable combination change member may be moved to axially disengage the lock wheels from the combination selection members and to rotationally fix the combination selection members, such that the lock wheels may be rotated prior to re-engaging the lock wheels with the combination selection members.

Figure 17:
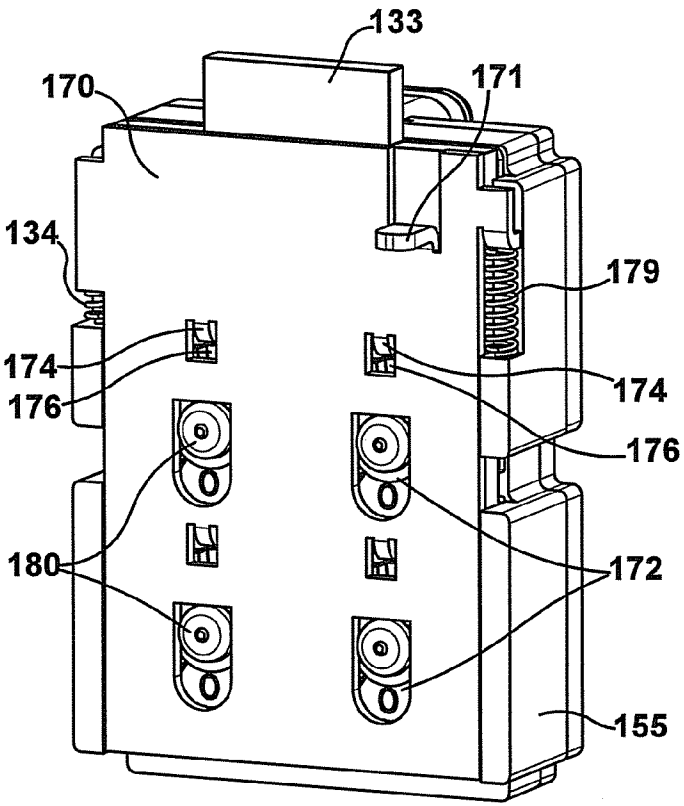
FIG. 17 is a rear perspective view of the locking arrangement of FIG. 1, shown with the housing removed.
Figure 16:
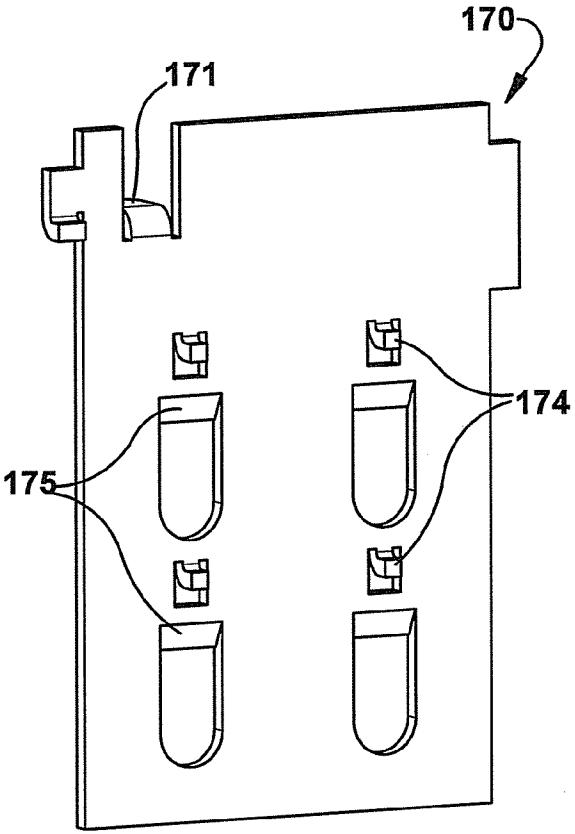
FIG. 16 is a perspective view of the combination change plate of the locking arrangement of FIG. 1.
Figure 15:
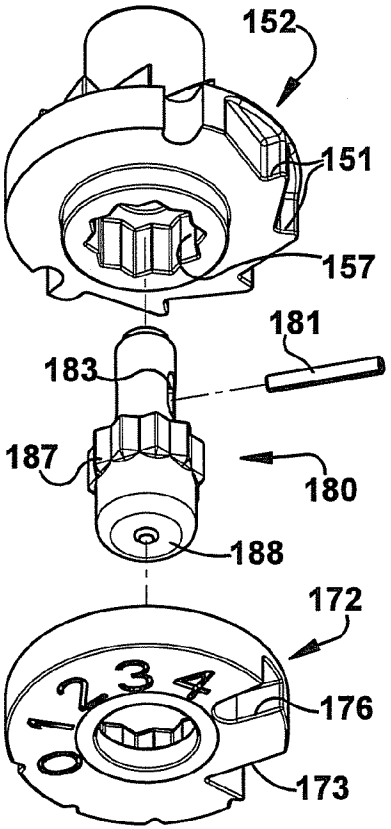
FIG. 15 is an exploded perspective view of a lock wheel, drive stem, and combination selection member subassembly of the locking arrangement of FIG. 1.
Figure 18:
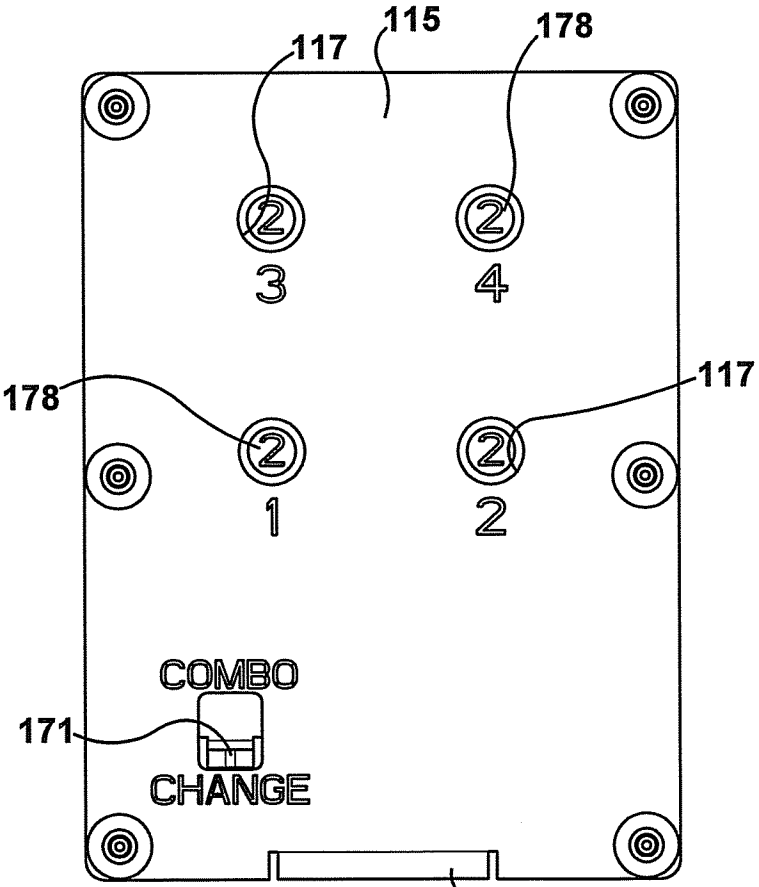
FIG. 18 is a rear view of the locking arrangement of FIG. 1.
Figure 19B:
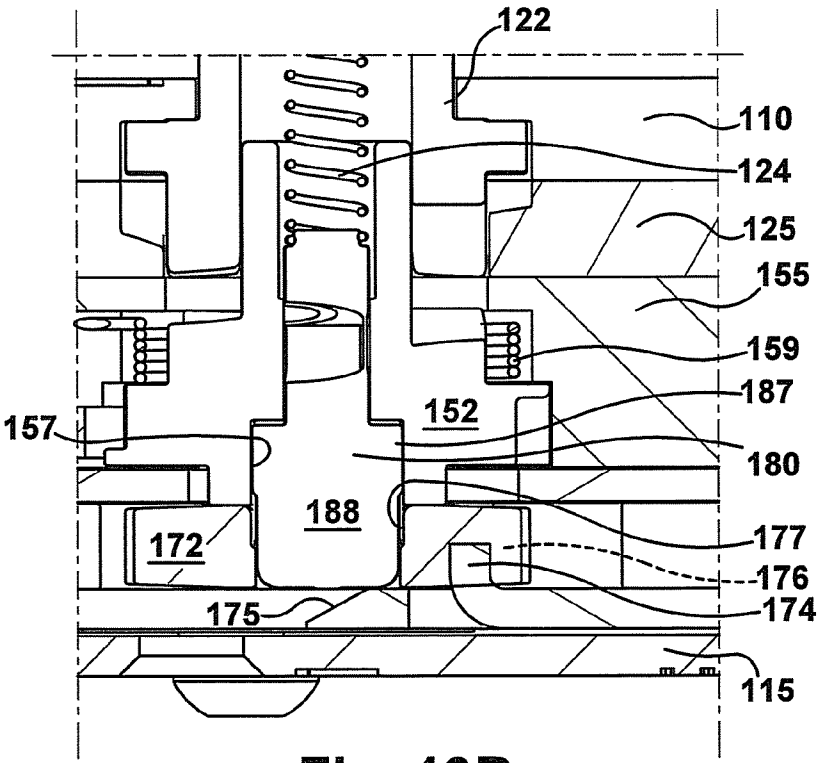
FIG. 19B is a partial cross-sectional view of the locking arrangement of FIG. 1, shown with the combination change plate in a code change position.
Figure 19A:
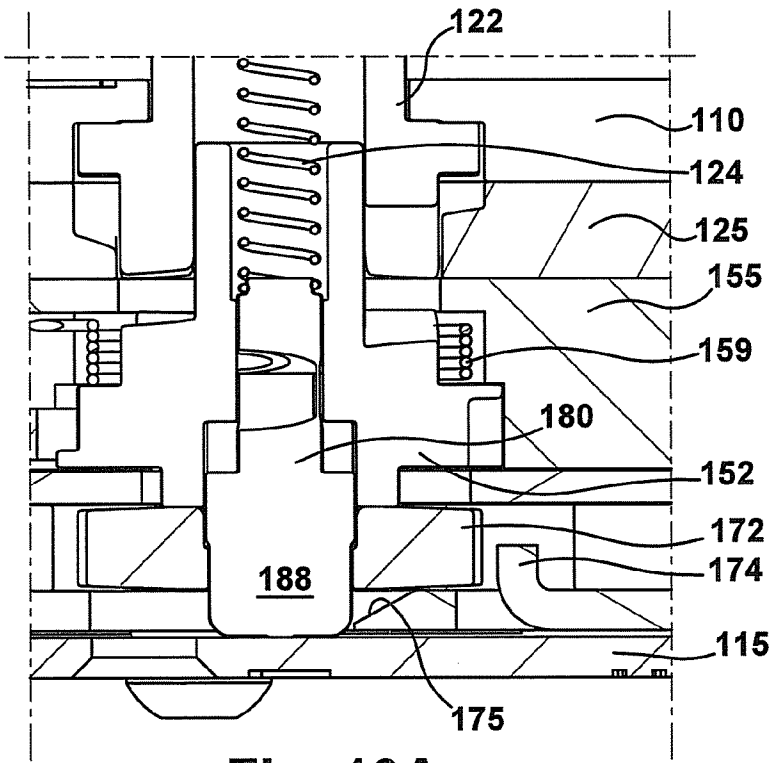
FIG. 19A is a partial cross-sectional view of the locking arrangement of FIG. 1, shown with the combination change plate in a normal position.

In the illustrated embodiment, as shown in the exploded view of FIG. 15, the lock wheels 152 are rotationally secured to corresponding combination selection members 172 by splined drive stems 180 having splined portions 187 that engage corresponding splined internal portions 157, 177 of the lock wheels 152 and combination selection members 172. The splined drive stems 180 are additionally secured to the lock wheels 152 by retaining pins 181 that are secured to the lock wheels 152 to slide within corresponding slots 183 in the drive stems 180, thereby permitting axial movement of the drive stems 180 with respect to the lock wheels 152 and combination selection members 172. As shown in FIGS. 16 and 17, a combination change plate 170 is disposed within the housing 110 and includes a user graspable actuation tab 171 accessible through the rear wall 115 of the housing 110 (FIG. 18). As shown in FIGS. 19A and 19B, when each of the combination selection members 172 is in the unlocking orientation, holding tabs 174 disposed on the combination change plate 170 align with corresponding recesses 176 in the combination selection members 172 to allow the combination change plate 170 to slide (i.e., by user movement of the actuation tab 171) against a biasing spring 179 (FIG. 17) to a code change position (FIG. 19B). In the code change position, ramp surfaces 175 on the combination change plate 170 engage end portions 188 of the drive stems 180 to axially move the drive stems 180 to disengage the splined portions 187 of the drive stems 180 from the internal splined portions 177 of the combination selection members 172, while maintaining engagement with the internal splined portions 157 of the lock wheels 152. While the holding tabs 174 rotationally fix the combination selection members 172, the lock wheels 152 are free to rotate with respect to the combination selection members 172, by pressing the corresponding buttons 122.

To change the authorized combination code, the current authorized combination code is entered a first time for movement of the latch member 133 to move the housing 110 with respect to the interlocked structure (e.g., safe enclosure, not shown), thereby allowing access to the rear side 115 of the housing 110. As the lock wheels 152 are reset upon releasing the latch member 133, the current combination code is then reentered to return the lock wheels 152 to the unlocking orientations. Alignment of the recesses 176 in the combination selection members 172 with the holding tabs 174 of the code change plate 170 allow for movement of the actuation tab 171 to slide the code change plate 170 from the normal position to the code change position, which engages the holding tabs 174 with the recesses 176 and cams the drive stems 180 out of rotational engagement with the combination selection members 172. With the holding tabs 174 rotationally fixing the combination selection members 172, selected buttons 122 are depressed a selected number of times to generate a new authorized combination code, thereby rotating the lock wheels 152 to new corresponding unlocking orientations. When the new authorized combination code has been entered, the actuation tab 171 is released, returning the code change plate 170 to the normal position (by force of biasing spring 179), and reengaging the combination selection members 172 with the lock wheels 152 in the new relative rotational positions.

In the illustrated embodiment, as shown in FIG. 18, to facilitate identification of the newly entered authorized combination code, windows or openings 117 in the rear wall 115 of the housing 110 (which may be secured to the housing, for example, by fasteners 119) are provided to align with a reference position on each of the combination selection members 172. When the reset button 162 has been depressed to return the lock wheels 152 to the zero position, a marked portion 178 or indicia of the combination selection dial 172 identifies the number of pressings of the corresponding button member 122 required to rotate the corresponding lock wheel 152 to the unlocking orientation.

Figure 20:
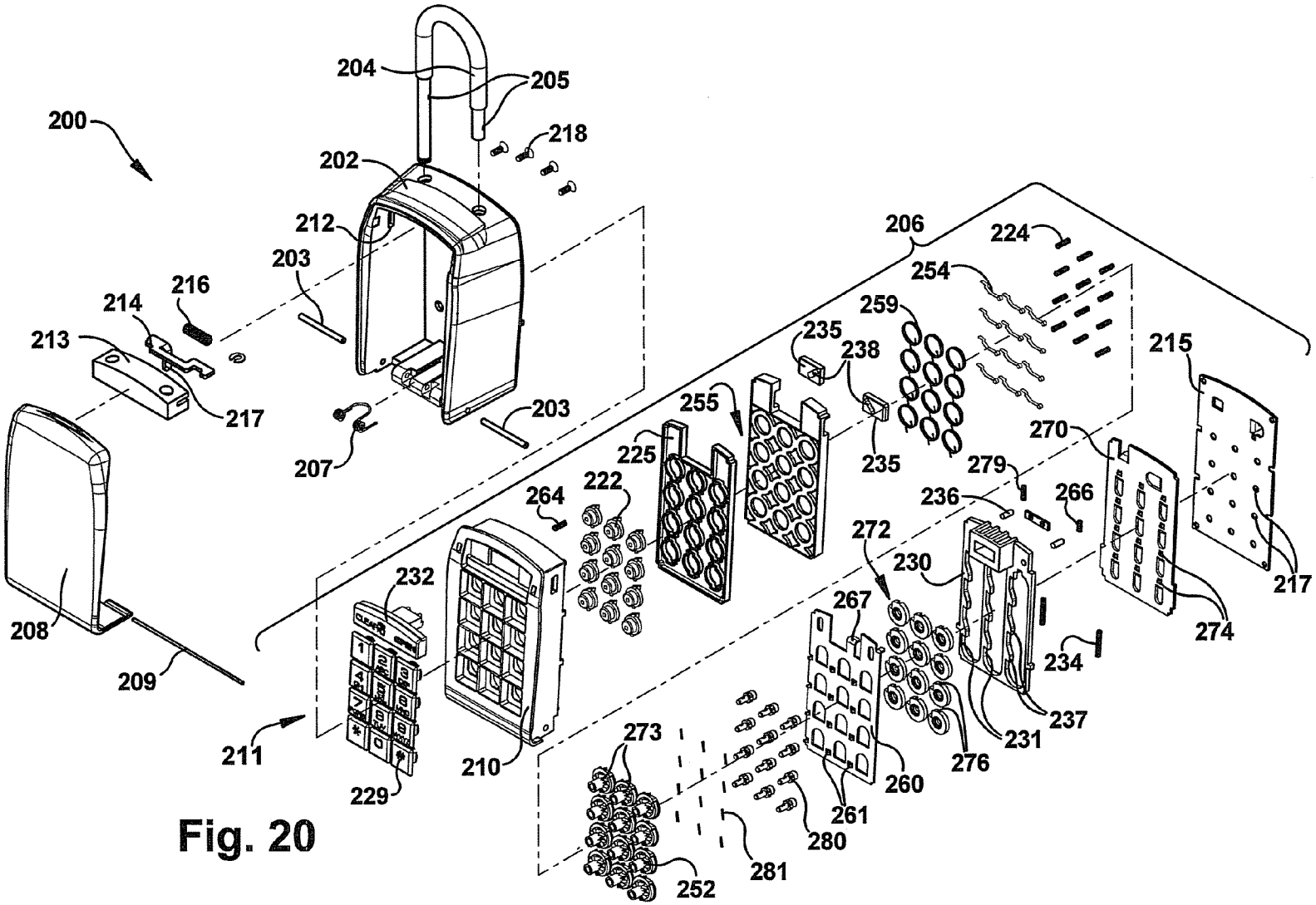
FIG. 20 illustrates an exploded perspective view of a safe with a mechanical pushbutton locking arrangement.
Figure 21:
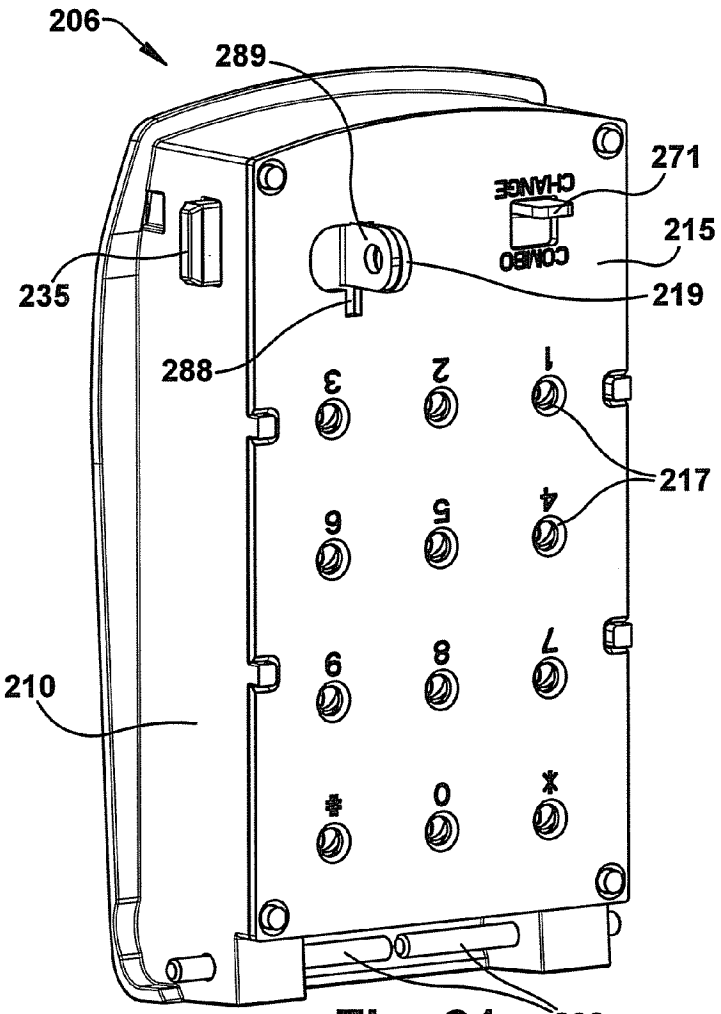
FIG. 21 illustrates a rear perspective view of the door assembly of the safe of FIG. 20.

FIGS. 20 and 21 illustrate features of an exemplary key safe 200 including many of the inventive features of the locking arrangement 100 of FIGS. 1-19B. As shown in the exploded view of FIG. 20, the key safe 200 includes a body 202, a shackle 204, a door assembly 206, and a button cover 208 pivotally connected to the body by a hinge pin 209. The door assembly includes a housing 210 defining a keypad portion 211 on which a plurality of button caps 229 are secured to a plurality of buttons 222. As shown, a spring 207 may be provided to bias the door assembly 206 toward the pivoted open position when unlocked. In the illustrated example, the door housing 210 is hingedly secured to the safe body 202 by hinge pins 203. Latch members 235 are assembled with a guide block 255 within the door housing 210 to extend from slots in the door housing 210 for secure engagement with notches in the safe body 202 when the locking arrangement is in a locked condition (i.e., when the authorized combination code has not been entered). Upon entry of the authorized combination code (i.e., by pressing the button(s) 222 corresponding to the combination code), a latch plate 230 within the door housing 210 becomes slideable to an unlocking position by user manipulation of a latch release button 232 associated with the latch plate 230. In the exemplary embodiment, the latch release button 232 is laterally secured to the latch plate 230 for lateral sliding movement therewith. This lateral sliding movement causes pins 236 affixed to the latch plate 230 to ride in slots 238 in the latch members 235 to retract the latch members 235 from internal notches 212 in the body 202, allowing the door 206 to be pivoted to an open condition. While the illustrated arrangement is provided as a locking door to a key safe or other small locking enclosure, a similar locking arrangement may be provided for an entry door, gate, padlock or other lockable structure. Also, while the illustrated embodiment includes twelve buttons 222 labeled (by markings on the button caps 229) to resemble a telephone keypad, it is to be understood that any number of buttons may be used, and that any one or more types of labeling or designations may be used to identify the buttons, including, for example, numbers, letters, colors, and images.

In the illustrated embodiment, each button 222 is provided in a pushbutton assembly 220, consistent with the pushbutton assembly 120 of FIG. 3, to provide for one or more incremental rotations of a lock wheel 252 in response to pressing the corresponding button 222. Like the embodiment of FIGS. 1-19B, if an incorrect button 222 is inadvertently pressed, or if a button is pressed too many times, the lock wheels 252 may be reset or returned to an initial or "zero" position for reentry of the combination code, by moving a reset plate 260 to force ratcheting leaf springs 254 out of engagement with peripheral gear teeth 251 of the lock wheels 252, allowing the lock wheels 252 to be rotationally biased back to the zero positions by torsion springs 259. While many different configurations may be utilized to slide the reset plate 260 from a normal condition to a reset condition, in the illustrated embodiment, the latch release button 232 is axially depressible to engage a camming end of the latch release button 232 with an upper edge 267 of the reset plate 260, thereby sliding the plate 260 such that the tabs 261 disengage the leaf springs 254 from the corresponding lock wheels 252. The reset button 262 is spring biased (by spring 264) to return the reset button 262 to the non-pressed condition, and the reset plate 260 is spring biased (by spring 266) to return the reset plate 260 to the normal position when the reset button 262 is released.

While many different configurations may be provided for locking and unlocking the latch members 235, in one embodiment, the latch plate 230 may be blocked from sliding movement when the authorized combination code has not been entered, and permitted to slide (i.e., for movement of the latch members) when the authorized combination code has been entered. In the illustrated embodiment, the latch plate 230 includes cutout portions 231 through which the pushbutton assemblies 220 extend. When the authorized combination code has been entered by pressing the corresponding buttons 222 a correct number of times (thereby placing each lock wheel 252 in an unlocking rotational orientation), outer peripheral notches 273 associated with each of the lock wheels 252 align with corresponding tabs or protrusions 237 in the latch plate 230. This arrangement allows the latch plate 230 to slide against a biasing spring 234 to a release position, by user manipulation of the attached latch release button 232, thereby withdrawing or retracting the latch members 235 to disengage the latch members from the safe body 202.

As with the embodiment of FIGS. 1-19B, when each of the combination selection members 272 is in the unlocking orientation, holding tabs 274 disposed on the combination change plate 270 align with corresponding recesses 276 in the combination selection members 272 to allow the combination change plate 270 to slide (i.e., by user movement of the actuation tab 271) against a biasing spring 279 to a code change position, in which splined portions of the drive stems 280 are disengaged from the internal splined portions of the combination selection members 272, while maintaining engagement with the internal splined portions of the lock wheels 252. While the holding tabs 274 rotationally fix the combination selection members 272, the lock wheels 252 are free to rotate with respect to the combination selection members 272, by pressing the corresponding buttons 222. Additionally, to prevent unwanted or unauthorized combination changes, the combination change plate 270 and housing rear wall 215 may be provided with aligned hasp portions 289, 219 (see FIG. 21). When a lock (e.g., a padlock) is secured through the aligned hasps 289, 219, movement of the combination change plate 270 to the code change position is prevented, as the combination change plate hasp 289 is prevented from sliding into a notch 288 in the rear wall 215.

As with the embodiment of FIGS. 1-19B, to facilitate identification of the newly entered authorized combination code, windows or openings 217 in the rear wall 215 of the housing 210 (which may be secured to the housing, for example, by fasteners) are provided to align with a reference position on each of the combination selection members 272. When the reset button 262 has been pressed to return the lock wheels 252 to the zero position, a marked portion of the combination selection dial 272 identifies the number of pressings of the corresponding button 222 required to rotate the corresponding lock wheel 252 to the unlocking orientation.

While many different configurations may be utilized to secure the safe to an external structure, in the illustrated embodiment, the safe body 202 is assembled with a U-shaped shackle 204 that may be secured to the body at both ends to affix the safe 200 to a doorknob, a hasp, or some other structure. In the illustrated embodiment, the ends of the shackle are received through openings in the body 202 and through a shackle block 213 secured within the body 202 (e.g., by fasteners 218). A shackle latch 214 is spring biased (by spring 216) within the shackle block 213 to engage notches 205 in the shackle 204. When the safe 200 is unlocked and the door 206 is pivoted open, the shackle latch 214 may be manually pressed (by engaging tab 217 of the shackle latch 214) against the spring 216 to release the shackle 204 for withdrawal of the shackle from the body 202. In other embodiments, other mounting arrangements may be utilized, including, for example, mounting fasteners extending through the rear wall of the safe body (with fastener head accessible from inside the safe body).

The mechanical pushbutton locking arrangements illustrated in FIGS. 1-21 and described herein is one exemplary embodiment of a locking arrangement utilizing inventive aspects of the present application. Other embodiments utilizing one or more of these inventive aspects will be apparent to those of ordinary skill in the art in view of the present disclosure.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A lock comprising:

a housing;

a keypad disposed on the housing, the keypad including a plurality of button assemblies, wherein each of the plurality of button assemblies comprises:

an axially depressible button member including a camming surface;

a lock wheel having a plurality of camming teeth, wherein pressing the button member causes the camming surface to engage one of the plurality of camming teeth, thereby incrementally rotating the lock wheel about a central axis of the button between a plurality of rotational positions; and a latch releasing feature secured to the lock wheel for rotation therewith, the latch releasing feature including an outer peripheral recess; and a latch assembled with the housing, the latch including an interior cutout portion defining a plurality of tabs, wherein when the button members of a predetermined one or more of the plurality of button assemblies are depressed a predetermined number of times, the outer peripheral recess of each of the plurality of button assemblies align with corresponding ones of the plurality of tabs to permit lateral sliding movement of the latch from a locked condition to an unlocked condition in which each of the plurality of tabs is received in a corresponding one of the outer peripheral recesses.

2. The lock of claim 1, further comprising a user operable latch release button configured to move the latch from the locked condition to the unlocked condition.

3. The lock of claim 1, wherein the latch comprises a latch member that is moved from an extended position to a retracted position when the latch is moved from the locked condition to the unlocked condition.

4. The lock of claim 3, wherein the latch comprises a latch plate, wherein the latch member is integral with the latch plate.

5. The lock of claim 3, wherein the latch comprises a latch plate, wherein lateral sliding movement of the latch plate in a first direction retracts the latch member in a second direction perpendicular to the first direction.

6. The lock of claim 1, wherein each button assembly further comprises a ratcheting member having a first portion secured to the housing and a second portion that engages the lock wheel to secure the lock wheel in one of the plurality of rotational positions.

7. The lock of claim 1, wherein the lock wheel of each button assembly comprises a notch adjacent to one of the plurality of camming teeth, the notch being positioned to engage the camming surface of the button member to provide a positive stop indication that the button assembly has reached a maximum number of pressings.

8. The lock of claim 1, wherein the button member of each button assembly is configured to rotate when released from a depressed condition, such that the camming surface of the released button member is oriented to align with an adjacent one of the plurality of camming teeth.

9. The lock of claim 8, wherein the button member of each button assembly includes a peripheral projection that rides in a ramped slot defined by the housing.

10. The lock of claim 1, wherein the housing includes a plurality of windows positioned to align with each of the lock wheels to expose indicia associated with each lock wheel, the indicia indicating a number of times that each corresponding button member has been depressed.

11. A lock comprising:

a housing;

a keypad disposed on the housing, the keypad including a plurality of button assemblies, wherein each of the plurality of button assemblies comprises:

an axially depressible button member including a camming surface;

a lock wheel, wherein pressing the button member a selected number of times causes the lock wheel to incrementally rotate from a zero position to a corresponding one of a plurality of selected rotational positions;

a torsion spring having a first portion secured to the housing and a second portion secured to the lock wheel for biasing the lock wheel toward the zero position; and a ratcheting member having a first portion secured to the housing and a second portion that engages the lock wheel to secure the lock wheel against rotational movement by the torsion spring; and a latch releasing feature secured to the lock wheel for rotation therewith;

a latch assembled with the housing, the latch including a plurality of blocking features, wherein when the button members of a predetermined one or more of the plurality of button assemblies are depressed a predetermined number of times, the latch releasing features of each of the plurality of button assemblies align with corresponding ones of the plurality of blocking features to permit movement of the latch from a locked condition to an unlocked condition; and a reset member including a plurality of projections each aligned with the ratcheting member of a corresponding one of the plurality of button assemblies, the reset member being selectively movable to force the plurality of projections against the corresponding ratcheting members to disengage the ratcheting members of each of the plurality of button assemblies from the corresponding lock wheels, thereby returning the lock wheels to the zero positions.

12. The lock of claim 11, wherein the ratcheting member of each of the plurality of button assemblies engages one of a plurality of peripheral gear teeth on the corresponding lock wheel.

13. The lock of claim 11, wherein the ratcheting member of each of the plurality of button assemblies comprises a leaf spring.

14. The lock of claim 11, wherein the lock wheel of each of the plurality of button assemblies comprises a radially extending protrusion that abuts a corresponding tab in the housing upon rotation of the lock wheel by the torsion spring, thereby aligning the lock wheel in the zero position.

15. The lock of claim 11, wherein the reset member comprises a reset plate including a plurality of reset tabs positioned to engage corresponding ones of the ratcheting members for disengagement of the ratcheting members from the lock wheels in response to movement of the reset member.

16. The lock of claim 11, wherein the reset member comprises an axially depressible reset button.

17. A lock comprising:

a housing;

a keypad disposed on the housing, the keypad including a plurality of button assemblies, wherein each of the plurality of button assemblies comprises:

an axially depressible button member including a camming surface;

a lock wheel, wherein pressing the button member a selected number of times causes the lock wheel to incrementally rotate from a zero position to a corresponding one of a plurality of selected rotational positions; and a combination selection member secured to the lock wheel for rotation therewith, the combination selection member including a latch releasing feature;

a latch assembled with the housing, the latch including a plurality of blocking features, wherein when the button members of a predetermined one or more of the plurality of button assemblies are depressed a predetermined number of times, the latch releasing features of each of the plurality of button assemblies align with corresponding ones of the plurality of blocking features to permit movement of the latch from a locked condition to an unlocked condition; and a combination change member slideable in a lateral direction to disengage the combination selection members of each of the plurality of button assemblies from the corresponding lock wheels, thereby allowing for adjustment of the rotational position of the lock wheel corresponding to alignment of the latch releasing feature with the blocking feature.

18. The lock of claim 17, wherein each of the button assemblies comprises a drive stem rotationally secured between the corresponding lock wheel and combination selection member, the drive stem being axially movable with respect to the corresponding lock wheel and combination selection member for disengagement from the combination selection member in response to movement of the combination change member.

19. The lock of claim 18, wherein the combination change member comprises ramp surfaces positioned to engage end portions of the drive stems for axial movement of the drive stems in response to movement of the combination change member.

20. The lock of claim 17, wherein when each of the combination selection members is rotated to an unlocking orientation, holding tabs disposed on the combination change member align with corresponding recesses in the combination selection members to allow for movement of the combination change member.

21. The lock of claim 17, wherein the combination change member is configured to move in a direction parallel to movement of the latch.

22. The lock of claim 17, wherein the combination change member includes a lock tab extending outward of the housing, such that insertion of a padlock shackle through an aperture in the lock tab prevents movement of the combination change member.

* * * * *